US009895601B1

(12) United States Patent
Wilk

(10) Patent No.: US 9,895,601 B1
(45) Date of Patent: Feb. 20, 2018

(54) WORD GAME AND METHOD OF PLAY

(71) Applicant: Michael Wilk, Goleta, CA (US)

(72) Inventor: Michael Wilk, Goleta, CA (US)

( * ) Notice: Subject to any disclaimer, the term of this patent is extended or adjusted under 35 U.S.C. 154(b) by 210 days.

(21) Appl. No.: 14/666,750

(22) Filed: Mar. 24, 2015

(51) Int. Cl.
*A63F 3/04* (2006.01)

(52) U.S. Cl.
CPC ..... *A63F 3/0423* (2013.01); *A63F 3/0421* (2013.01); *A63F 2003/0428* (2013.01)

(58) Field of Classification Search
CPC ..... A63F 3/0423; A63F 3/0421; A63F 2003/0428
USPC ..... 463/7, 8, 9, 10
See application file for complete search history.

(56) References Cited

U.S. PATENT DOCUMENTS

| | | | | |
|---|---|---|---|---|
| 2,752,158 | A | 6/1956 | James et al. | |
| 3,413,004 | A | 11/1968 | Smith et al. | |
| 3,472,514 | A | 10/1969 | Green et al. | |
| 4,252,323 | A | 2/1981 | Levinrad | |
| 4,420,157 | A | 12/1983 | White et al. | |
| 4,892,319 | A | 1/1990 | Johnson, II | |
| 5,058,896 | A | 10/1991 | Bez | |
| 5,139,271 | A | 8/1992 | Bez | |
| 5,324,040 | A | 6/1994 | Panda | |
| 5,395,118 | A | 3/1995 | Barrett | |
| 5,556,102 | A * | 9/1996 | Huang | A63F 3/0423 273/299 |
| 2004/0051246 | A1 | 3/2004 | Dunn | |
| 2005/0006844 | A1 * | 1/2005 | Cavallo | A63F 3/0423 273/272 |
| 2005/0178676 | A1 | 8/2005 | Bonner | |
| 2005/0230914 | A1 | 10/2005 | Campbell | |
| 2008/0203661 | A1 | 8/2008 | Daniels | |
| 2010/0283207 | A1 * | 11/2010 | Dokic | A63F 1/02 273/299 |

OTHER PUBLICATIONS

Martin Gardner in Martin Gardner's New Mathematical Diversions from Scientific American (University of Chicago Press, 1983)., p. 24-29.

Non-Final Office Action, dated Mar. 27, 2014, U.S. Appl. No. 13/714,433, filed Dec. 14, 2012.

* cited by examiner

*Primary Examiner* — Dmitry Suhol
*Assistant Examiner* — Brandon Gray
(74) *Attorney, Agent, or Firm* — Carr & Ferrell LLP

(57) ABSTRACT

A word game apparatus and method of play involving each player being represented by a set of square tiles of uniform color having various indicia imprinted thereon. Players in turn play these tiles to a game board having a grid pattern of squares. One color is declared the winner when a path of contiguous tiles of that color is formed between two end zones in accordance with the rules of the game. In some embodiments the game components are rendered using physical objects, and in other embodiments the game is implemented on computers with the game components appearing as images on electronic displays.

14 Claims, 7 Drawing Sheets

WORD GAME AND METHOD OF PLAY

FIELD OF THE INVENTION

The present disclosure relates generally to word games. More specifically, the present disclosure relates to a word game having an engaging method of play.

BACKGROUND

Board games involving wordplay have been manufactured for over 130 years. These games promote education, enjoyment and competition. To play these games with expertise, a player must possess an extensive or even a specialized vocabulary, and must also possess the ability to arrange letters to form acceptable words; however, few word games require much in the way of strategic skill.

There remains a considerable opportunity for a word game that combines wordplay and strategy, and with rules that are simple and coherent.

SUMMARY

Provided herein are apparatus and methods for a stimulating game that combines wordplay and strategy, and which satisfies its players by having rules that are uncomplicated and uncontrived.

In one embodiment, a game apparatus includes a board (also referred to as a game board) marked off in a grid pattern of squares. The game board is also marked with end zones, e.g., black stripes along two opposing edges and white stripes along the other two opposing edges. There are two sets of game tiles: a set of black tiles and a set of white tiles. In preferred embodiments, tiles are printed or imprinted with an alphabetic letter on only one side.

In preferred embodiments the game is played by two players: e.g., a player who plays the black tiles and a player who plays the white tiles. In other embodiments, three or more players may play the game, and players may play individually or on two or more opposing teams. In still other embodiments, one or more players may play against a computer or other automated "player". In the two-player (or two-team) example, players play their tiles to the board in standard crossword fashion, but with the black tiles oriented perpendicularly to the white tiles. This orientation serves as a reminder that words are formed using either all black tiles or all white tiles, and not a combination of black and white.

In preferred embodiments, a goal for each player of the game is to set down a path of tiles that runs between the two end zones of said player's color in accordance with the rules of the game. The first player to complete such a path is the winner.

The game may be played conventionally using a physical apparatus, including a game board, tiles and other physical components. The game may also be played using a computer or other electronic system, e.g., wherein game components may appear as images on electronic displays.

A method of playing a word game according to the present invention may comprise providing a shared playing area having a grid of playing spaces and two pairs of end zones disposed at opposing outer edges of the grid. Each player is assigned a set of tiles, with each tile of each set configured and dimensioned to fit within any of the playing spaces. The front surface of each tile includes a letter and the back surface of each tile is blank or otherwise indistinguishable from the back surface of other tiles in the same set. The two sets of tiles are distinguishable from each other, e.g. one player has a black set and the other has a white set. Each player is assigned a pair of end zones corresponding to their tile color. Each player also receives a pouch for holding their set of available tiles and a rack or other private viewing device or area for holding a predetermined number of tiles drawn from the pouch such that the drawn tiles are visible only to that player. Players take turns in order (also referred to as alternating or alternating order). A turn is a play of one or more tiles from the rack to any unoccupied spaces on the shared playing area, provided that: (i) all played tiles are placed face up; (ii) played tiles are arranged linearly; (iii) no unoccupied squares or opponent's tiles come between any tiles played in a single turn; (iv) acceptable words are formed in standard crossword fashion where tiles of a like color meet; and (v) at least one acceptable word is newly formed by the play. A turn may also be a play of a single tile from a player's private tile viewing area to any unoccupied space within the shared playing area if the tile is placed face down. A turn may also be an exchange of one or more tiles chosen by a player from the player's private tile viewing area, swapped with an equal number of tiles selected randomly from available tiles in the player's assigned set of tiles. After a play of a number of tiles to the shared playing area, the player replaces the number of played tiles with a corresponding number of new tiles from the available tiles in the player's assigned set of tiles. A winner is declared when a player forms a continuous path of adjacent tiles of their assigned game color between the game color's two end zones. A draw may be declared if there are a predetermined number of sequential passes or swaps or successfully challenged plays, or if the players agree to a draw.

Advantages of one or more aspects may include:

- Although other word games are strategic to some degree, most emphasize wordplay far more than strategy. The games and methods presented herein may encourage and reward more advanced tactical thinking, e.g., a skilled player must think several moves ahead. Having the freedom to play words unconnected to previously played words results in a rich level of strategic play. The games described herein may also utilize a great deal of defensive, not just offensive, play.
- Games played using the apparatus and methods herein rarely end in stalemate, an aspect facilitated by the "diagonal rule" described herein.
- The distinctive orthogonal orientation of the game tiles makes rotation of the board unnecessary, a convenience for players.
- In preferred embodiments, a game is won based on the positions of the game pieces. The inconvenience of keeping a point tally is eliminated.
- The player to play first does not have a significant advantage.

These and other advantages of one or more aspects will become apparent from a consideration of the ensuing description and accompanying drawings.

BRIEF DESCRIPTION OF THE DRAWINGS

For a better understanding of the nature and objects of the invention, reference should be made to the following detailed description taken in conjunction with the accompanying drawings, in which.

Like reference numerals refer to the same or similar components throughout the several views of the drawings. In some cases, numbers such as X and X' may be used to refer to items that are the same or similar, except for certain distinguishing elements as noted in the following detailed description.

DETAILED DESCRIPTION

Figure 1:
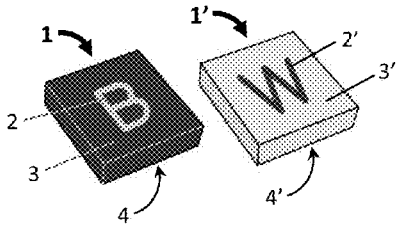
FIG. 1 is a perspective view of playing tiles in each of two colors, black and white, in accordance with a first embodiment.

Described herein are apparatus and methods for a board game that combines wordplay and strategy. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

The best-known board game involving wordplay is undoubtedly Scrabble (U.S. Pat. No. 2,752,158 (1956) to Brunot et al.), where players take turns placing lettered tiles drawn randomly from a common pool onto a 15×15 playing grid in crossword fashion, scoring points as they do so. Once all tiles have been played to the board, the player with the most points is the winner. Good gameplay requires some strategy, but nothing as rich as that required by chess, go or gomoku, for example. U.S. Pat. No. 4,252,323 (1981) to Levinrad and U.S. Pat. No. 5,395,118 (1995) to Barrett disclose games similar to Scrabble, but with different scoring systems. One distinction of Levinrad's game is the ability to place a lettered tile either face up or face down.

To add opportunities for more strategic play, some word games challenge players to build a series of connected words between two points or lines. U.S. Pat. No. 5,058,896 (1991) to Bez discloses a word game that has lettered tiles and a board but no scoring system. Instead, players place tiles to form connected words that extend from a start region to a goal region. U.S. patent application US 2004/0051246 by Dunn describes a similar game, but where players race in parallel but opposite directions; also, game tiles have indicia on both surfaces so that players may use a common set of tiles. U.S. Pat. No. 5,324,040 (1994) to Panda discloses a game with hexagonal tiles played to a hexagonal board. This game contains some inelegant rules so that games do not frequently end in stalemate; for example, allowing any sequence of all vowels or all consonants to be considered an acceptable word. U.S. Pat. No. 4,892,319 (1990) to Johnson discloses a word game where players place letters and retain ownership of those letters, and where players can capture letters from other players.

There exist board games without wordplay where players vie to be the first to build a connected series of game pieces in some predetermined way. These games are known collectively as "connection games." In October 1958, Scientific American published an article that described a game originally called "Gale" (after inventor David Gale) which two years later sold as "BRIDG-IT" by Hasbro. BRIDG-IT is a good children's game, but it can always be won by the first player if that player follows a simple set of rules. In 1962, 3M (and later Avalon Hill) published TwixT (invented by Alex Randolph), another abstract connection game.

Game Apparatus

The following description pertains to an embodiment of a board game apparatus and method played in English, for which words are based on the Latin alphabet of 26 letters. However, one skilled in the art will appreciate that other languages, alphabets, letters and/or symbols may be employed without departing from the scope of the invention.

Referring to FIG. 1, in one embodiment a game employs two sets of square playing tiles 1 and 1', preferably of uniform size and configured such that tiles 1 of the first set are distinguishable from tiles 1' of the second set. For example, the first set may comprise a plurality of black tiles 1 and the second set may comprise a plurality of white tiles 1'. Each black tile 1 in a set may be printed or imprinted in a light color with a single majuscule letter 2 of the Latin alphabet on one surface 3. The opposite side, or opposing surface 4, of each such tile may be blank or printed with a uniform design (not shown). The second set contains tiles 1' identical to those in the first set except that these tiles have a white surface 3' with dark lettering 2'. Side 4' of tile 1' is preferably blank or printed with a uniform design as described for tile 1. (Note: tiles 1, 1' of both players are sometimes generically referred to herein as tiles 1.)

In other embodiments, one set of tiles may be used. For example, a first side of each tile may comprise a certain color or design (e.g., a dark surface 3 with light lettering 2 as shown for tile 1 of FIG. 1), and the second, or opposite, side (e.g., side 4 of tile 1) is of a different color or design that is distinguishable from the first side (e.g., a light tile surface with dark lettering). In such embodiments, the numbers of tiles and distribution of letters, blanks and/or other indicia may be modified to facilitate a desired length of game and/or size or configuration of game board, or to effect desired modifications of game rules. In other embodiments, more than two sets of tiles may be employed.

The quantity of tiles 1, 1' in each set may vary. In some embodiments, 96 tiles in each set are sufficient. While not wishing to be limited to a specific number or distribution of tiles, by way of example the following distribution of letters for an English rendition of the game allows players to form a satisfying diversity of allowable words.

| Letter | Number of black tiles so marked* | Letter | Number of black tiles so marked* |
|---|---|---|---|
| A | 8 | N | 5 |
| B | 2 | O | 6 |
| C | 3 | P | 3 |
| D | 4 | Q | 1 |
| E | 12 | R | 7 |
| F | 1 | S | 6 |
| G | 3 | T | 6 |

-continued

| Letter | Number of black tiles so marked* | Letter | Number of black tiles so marked* |
|---|---|---|---|
| H | 2 | U | 4 |
| I | 7 | V | 1 |
| J | 1 | W | 1 |
| K | 1 | X | 1 |
| L | 5 | Y | 2 |
| M | 3 | Z | 1 |

*In this example, the white tiles 1' are essentially identical, except in color, to the black tiles 1, so they are supplied in these same quantities.

Figure 2:
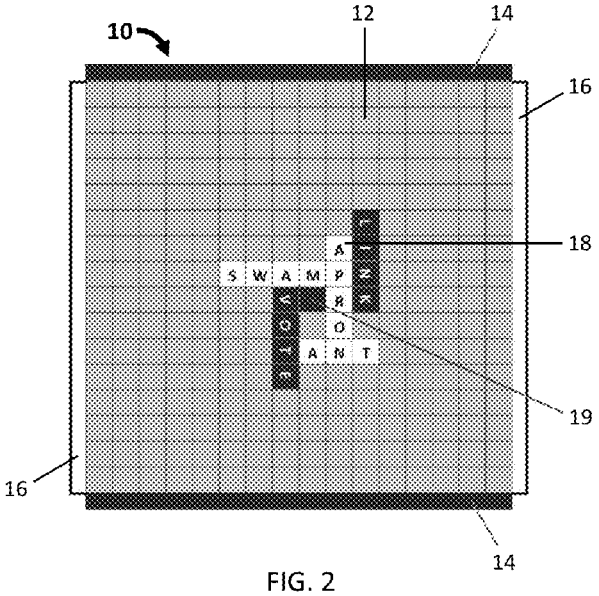
FIG. 2 is a plan view of a game board, including a playing grid, end zones, and a plurality of playing tiles thereon.

Turning now to FIG. 2, game apparatus may also include a game board 10 (also referred to as board 10) having a grid pattern of contiguous squares 12 and pairs of opposing edges 14, 16, referred to herein as "end zones". In preferred embodiments, two end zones 14 are on opposite ends of board 10 from each other and distinguishable (e.g., by color or ornamentation) from end zones 16. For example, end zones 14 may be marked in black to match black tiles 18 (or another color corresponding to the first set of tiles 1) and end zones 16 may be marked in white to match white tiles 19 (or another color corresponding to the second set of tiles 1'). In some embodiments, squares 12 are configured in a 16×16 grid pattern, and each square is dimensioned to accommodate a tile 1, 1'. Other grid patterns and/or board dimensions may be used without departing from the scope of the invention. For example, in some embodiments, grid patterns such as 15×15, 17×17, 18×18, 20×20, 22×22, 24×24, or more are employed. In other embodiments, board 10 may comprise a grid pattern larger than 16×16 and/or one or both end zones 14, 16 may be moveable such that a user may place them in a desired location depending upon a desired length or complexity of the game, or to compensate for a difference in experience or skill between players.

* In this example, the white tiles 1' are essentially identical, except in color, to the black tiles 1, so they are supplied in these same quantities.

Figure 3:
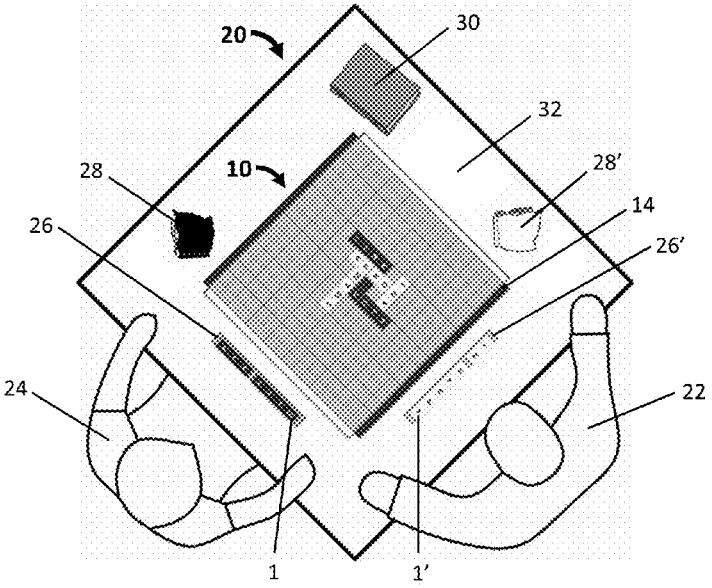
FIG. 3 is a plan view of a seating arrangement of players with respect to the game apparatus of FIGS. 1 and 2, in accordance with the first embodiment.

Referring to FIG. 3, a game apparatus 20 (also referred to as game 20 and apparatus 20) according to one embodiment may include board 10 and two sets of tiles 1 and 1'. Pouches 28, 28' or other devices may be used to hold available tiles in each set, such that tiles in the pouch are not visible to either player 22, 24. In other embodiments, undrawn tiles may be kept undisclosed by positioning them face down on a flat surface, e.g., the surface 32 of a table or other device for supporting the game board 10. As used herein, a "pouch" may refer to a pouch, bag, sack, box, container, surface or other device or method for holding or positioning undrawn tiles such that at least the face of such tiles are not visible the players.

Racks 26, 26' or other devices may be provided to hold the drawn tiles 1, 1' of each player 22, 24, e.g., such that drawn dark tiles 1 are visible only to player 24 and drawn light tiles 1' are only visible to player 22. Rack 26, 26' is preferably configured and dimensioned to hold a desired number of tiles, e.g., 7, 8 or more tiles, at an angle that facilitates viewing of the face 2, 2' of the drawn tiles by the respective player, but hidden from view of the opponent. In other embodiments, an opaque screen or other device may be employed to shield each payer's tiles from view by the opponent.

Game 20 may also include a word-validating device 30, such as, for example, a dictionary. In some embodiments, an electronic dictionary, laptop computer, tablet computer, or smart phone including a dictionary or network access to a dictionary may be used.

Example: 2-Player Game Method

Apparatus 20 may be used to play a game as a contest between two individuals or two teams. For simplicity, hereafter the game is described as between individual players.

Players preferably are positioned at adjacent edges of board 10 rather than across from each other, such that each player sits directly in front of one of their opponent's end zones, e.g., player 22 chooses white and faces the opponent's black end zone 14 and player 24 chooses black and faces white end zone 16, as shown in FIG. 3. For convenience, Player 22 is sometimes referred to herein as "white player" and player 24 is sometimes referred to as "black player".

Figure 4:
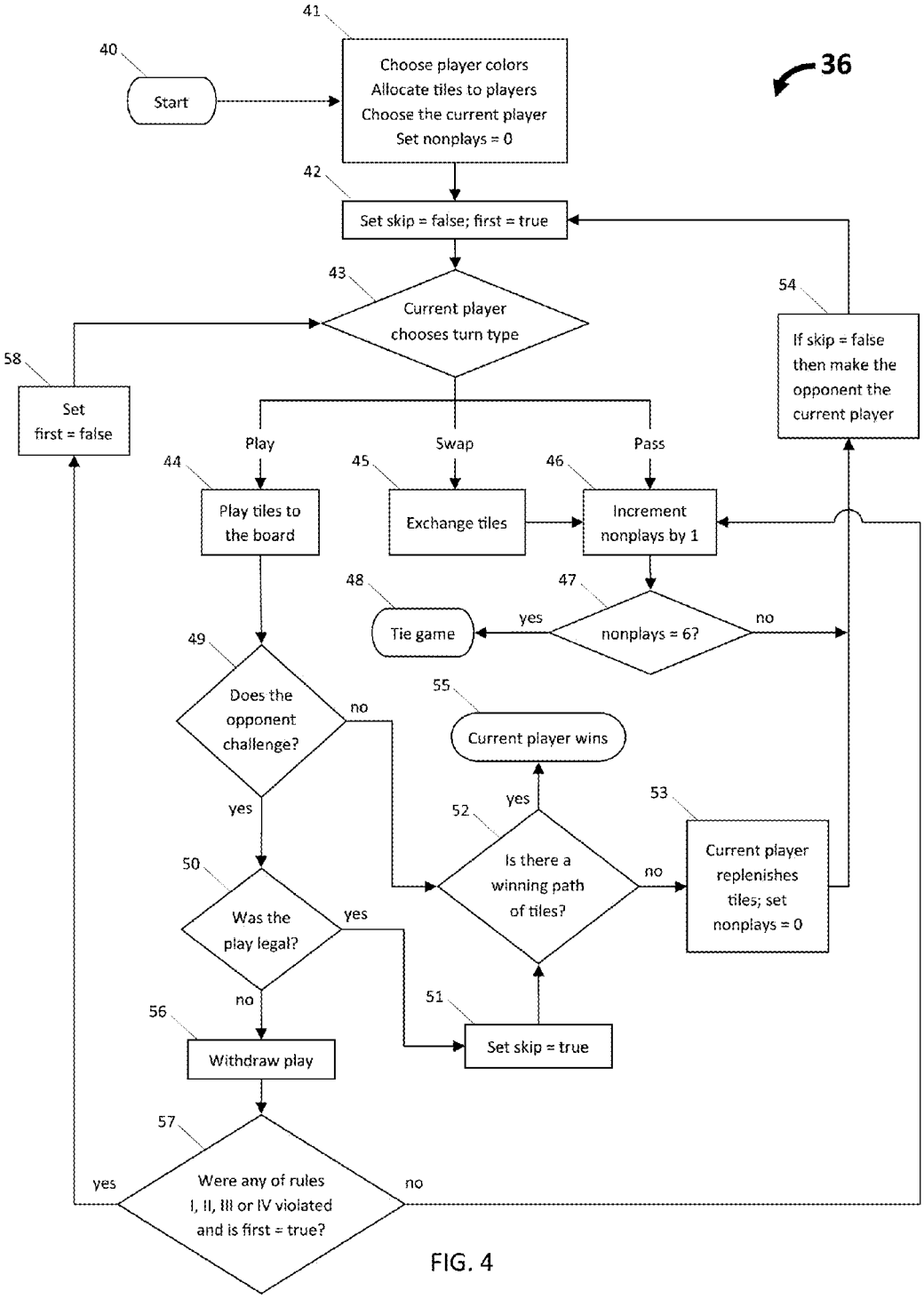
FIG. 4 is a flowchart of a method of playing a game using the apparatus of FIGS. 1-3.

FIG. 4 provides a flowchart of a method 36 of playing a game using board 10, tiles 1 and associated apparatus. The method 36 may apply to both physical and electronic versions of the game.

The example method 36 may start 40 with choosing player colors 41, e.g., black for one player and white for the other player. To allocate the tiles in step 41, the black player takes the pouch containing all of the black tiles (e.g., pouch 28) and the white player takes the pouch containing all of the white tiles (e.g., pouch 28'). The player to move first may be determined by each player drawing one tile from their respective pouches. The player who draws closest to the beginning of the alphabet has the first turn. In case of a tie, players repeat until unequal tiles are drawn. After returning these two tiles to their respective pouches, in this example each player then draws eight tiles at random from their pouch and places those tiles on their tile rack.

Alternatively, other methods of choosing the first player may be employed. In some embodiments, fewer than eight tiles or more than eight tiles may be drawn by each player, e.g., depending upon a desired length and complexity of the game.

Players take turns. A player on their turn chooses 43 whether to play 44, swap 45 or pass 46:

Play: If the current player plays 44 their tiles on the board, it must be a legal play as described below. After a legal play 44, the player replaces 53 any played tiles with an equal number of new tiles drawn at random from their pouch. If their pouch contains an insufficient number of tiles, the player takes all the tiles from their pouch (if any).

Swap: The player may exchange 45 any number of tiles on their rack with an equal number of tiles from their pouch. If there are fewer tiles in their pouch than on their rack, the player may exchange no more tiles than are in their pouch.

Pass: The player may pass 46 their turn without taking an action.

Legal Plays

In preferred embodiments, tiles may be played to the board face up or face down:

Face up: The player takes any number of tiles from their rack and places each tile face up on an unoccupied square on board 10, orienting the tiles so that they face said player. Because players face the game board at right angles to each other (e.g., as shown in FIG. 3), on the board the black tiles will be oriented perpendicularly to the white tiles.

Face down: The player takes exactly one tile from their rack and places it face down on an unoccupied square on the board 10. The player need not disclose to the opponent what letter is on the tile. This tile preferably does not represent a wildcard letter but represents a blank space that is part of no word. In other embodiments, a blank tile or a tile with other desired ornamentation or symbol may represent a wildcard letter.

After all tiles are placed by a player for their particular turn, the play is considered legal if it obeys the following placement rules:

RULE I: All played tiles must be in the same row or the same column.

Figure 5A:
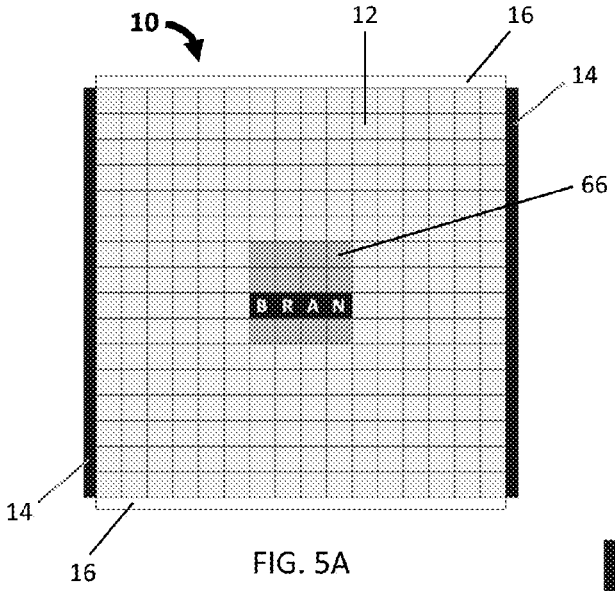
FIGS. 5A-5C are plan views of the apparatus of FIG. 2, depicting stages of progress of a game.

RULE II: If this is the first play of the game, all played tiles must be confined to the central sixteen squares of the board, e.g., as shown in FIG. 5A by region 66. Hence, at most four tiles may be played in the first play. In other embodiments, region 66 may comprise a number of squares other than sixteen.

RULE III: No unoccupied squares or opponent's tiles may come between any tiles played on a single turn.

RULE IV: A tile may be placed diagonally to one of the player's previously played tiles only if another of the player's tiles is adjacent to both. The terms "adjacent" and "diagonal" are used herein as follows:

a. Adjacent: Two squares are considered "adjacent" if said squares share a common edge. Likewise, two tiles are considered "adjacent" if said tiles occupy adjacent squares.

b. Diagonal: Two squares are considered "diagonal" to each other if said squares meet only at a single point at one corner of each square. Likewise, two tiles 1 are considered "diagonal" to each other if said tiles occupy squares that are diagonal to each other. Note that two squares or tiles positioned diagonally to each other are by definition not adjacent.

Figure 6A:
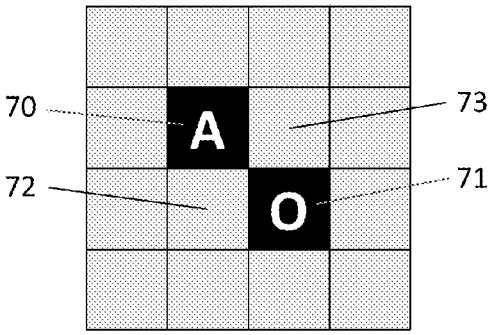
FIGS. 6A-C are plan views of game tiles illustrating a "diagonal rule", which restricts the placing of tiles.
Figure 6B:
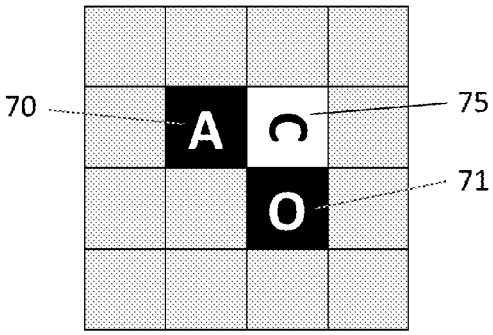
Figure 6C:
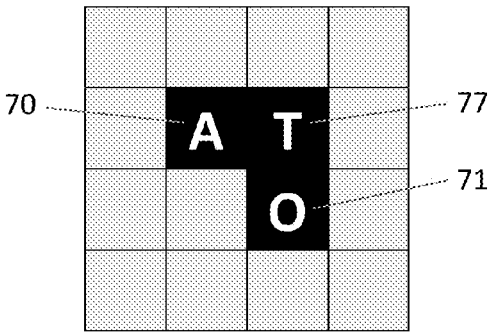

This Rule IV, referred to herein as the "diagonal rule", is further illustrated in FIGS. 6A-6C. In FIG. 6A, black tiles 70 and 71 violate the diagonal rule because they touch at their corners, but neither of the two squares 72 or 73 that are adjacent to tiles 70 and 71 contains a black tile.

In FIG. 6B, black tiles 70 and 71 similarly violate the diagonal rule because they touch at their corners, but neither of the two squares 72 or 73 that are adjacent to tiles 70 and 71 contains a black tile. The presence of white tile 75 has no bearing on whether or not the diagonal rule is violated for the black tiles 70, 71 (except to the extent that white tile 75 blocks the corresponding square from placement of a black tile).

In FIG. 6C, black tiles 70 and 71 do not violate the diagonal rule because, although they touch at their corners, black tile 77 is adjacent to both tiles 70 and 71.

Figure 5B:
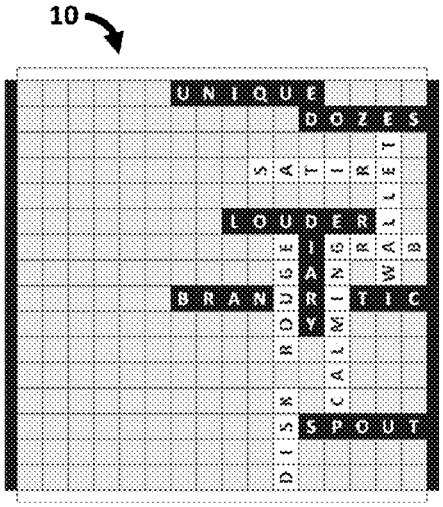
Figure 5C:
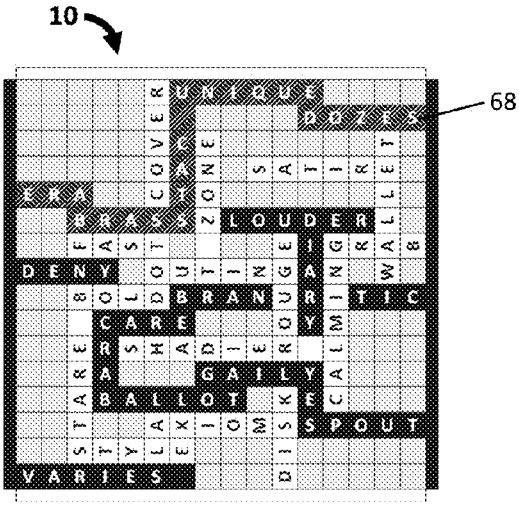

Two additional rules apply when tiles are played face up:

RULE V: Acceptable words must be formed in standard crossword fashion where tiles of a like color are adjacent, for example, as shown in FIGS. 5A-5C.

RULE VI: At least one acceptable word must be newly formed by the play.

In some embodiments, it is not a requirement that played tiles be adjacent to any previously played tiles. Tiles may be placed anywhere on the board as long as the play does not violate the above-listed rules.

After a legal play, tiles remain in their squares for the remainder of the game. Tiles on the board are preferably not inverted once played—e.g., face-up tiles remain face up, and face-down tiles remain face down.

In the described embodiment, each player forms words using their tiles only. An opponent's tiles are nothing more than barriers to a player's own path-building progress.

Challenges

Some exemplary embodiments may provide the ability to challenge a play of an opposing player. Electronic versions of the exemplary game may forbid a player from making an illegal play, and so challenges would not arise. Therefore, challenges may not exist in some electronic versions of the game.

Returning to FIG. 4, after a player plays tiles to the board 44, the player's opponent may challenge 49. In issuing a challenge, the opponent must state one rule that the opponent believes has been violated. If it is determined in step 50 that the play from 44 follows the stated rule (and is therefore "legal"), the opponent misses a turn. For example, in some embodiments (e.g., using computer logic to manage the flow of the game), a set skip=true operation 49 may be used to indicate that the opponent must skip a turn. In such event, if there is no winning path of tiles 52 as a result of the play, the current player replenishes 53 their tiles by drawing from corresponding pouch 28, 28' the number of tiles played and placing the drawn tiles on rack 26, 26' such that they are visible to the player but not to the opponent. Because "set skip=true" from step 51, the current player remains the current player in step 54 and that player takes another turn in step 43. A set skip=false; first=true operation 42 or similar operation may be used to reset player tracking logic for the next play. Though this description is provided in terms of computer logic, and may be implemented on a computer, FIG. 4 is a diagram showing the flow of the game, and is not solely intended for a software implementation, but also reflects game play in a physical game.

If it is determined in step 50 that the play from 44 violates the stated rule, then the play is removed 56. In some embodiments, violating a rule automatically results in the end of the play and the opponent becomes the current player 54 and chooses a turn type 43. In other embodiments, as shown in FIG. 4, how the game proceeds after a rule violation may depend upon which rule was violated. For example, in step 57 if it is determined that any of Rules I to IV were violated and it is the first violation on this turn, then the player is allowed a second opportunity without penalty to play again 44, swap 45 or pass 46. If, in this example, the violated rule is Rule V or Rule VI, or if the player has already withdrawn an illegal play in that turn, then the opponent is made the current player 54 and has the next turn 43 to either play 44, swap 45 or pass 46. In other embodiments, player may be allowed a greater or fewer number of rule violations, or different types of violations, within each turn or within the entire game.

Determining whether or not a play violates Rule V or Rule VI may require the use of a word-validating device, e.g., device 30. Note that if English is the language of the game, in some embodiments, some words may never be acceptable regardless of the choice of word-validating device: e.g., words of a single letter, words that always begin with a capital letter, abbreviations, prefixes and suffixes standing alone, and words that require a hyphen or apostrophe.

If an opponent wishes to challenge 49, said opponent must do so before the following turn is completed. If the opportunity to challenge a play is missed, that play remains in place for the remainder of the game regardless of its legality.

Winning the Game

FIGS. 5A-5C show a game in stages: after the first play in region 66 in FIG. 5A, in mid-game after several plays by each player in FIG. 5B, and at the end of the game in FIG. 5C. Returning to FIG. 4, a player wins the game 55 when they are the first to build a winning path 52 of that player's tiles between the corresponding end zones. A winning path is a continuous path of adjacent tiles of the same color reaching both of that player's two end zones 14 or 16. For example, path 68 in FIG. 5C is a continuous path of adjacent tiles of black tiles, played in accordance with the rules described above, reaching both black end zones 14.

A game ends in a tie 48 if there are six consecutive non-plays 47 or successfully challenged plays 57, e.g., a total of six passes 46 and/or swaps 45 in a row (three from each player). A tie game may also occur if the players agree to a draw. Any player may voluntarily forfeit the game at any time.

Example: Computer-Implemented Embodiments

In some embodiments, rather than physical objects for the game apparatus as described above, a game such as game method 36 of FIG. 4 may be implemented in computer software or firmware. In such embodiments, rules of the game may be essentially the same or similar to those described with respect to FIG. 4, except that board 10, tiles 1 and other game apparatus may appear as images on an electronic display system.

Figure 7:
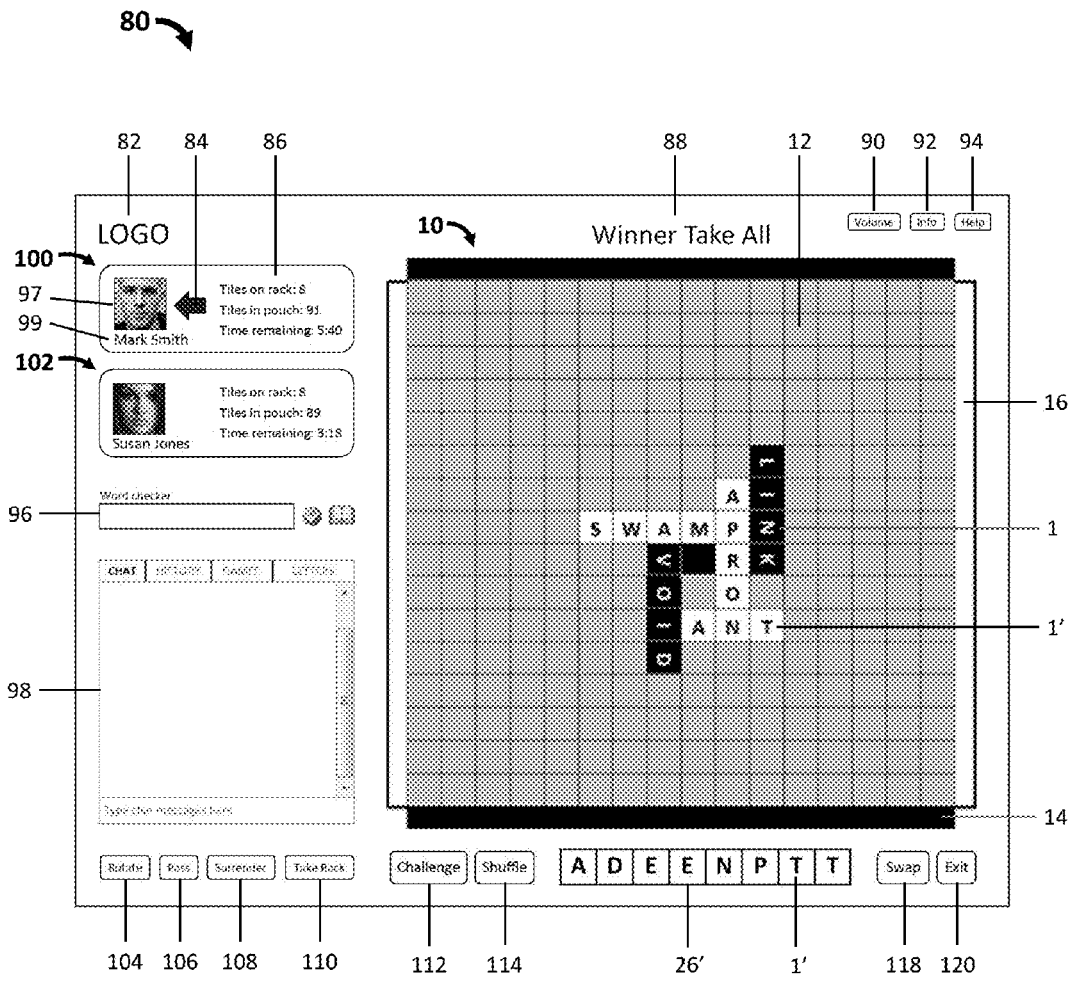
FIG. 7 is a schematic rendering of a game having an electronic display system, in accordance with a second embodiment.
Figure 8:
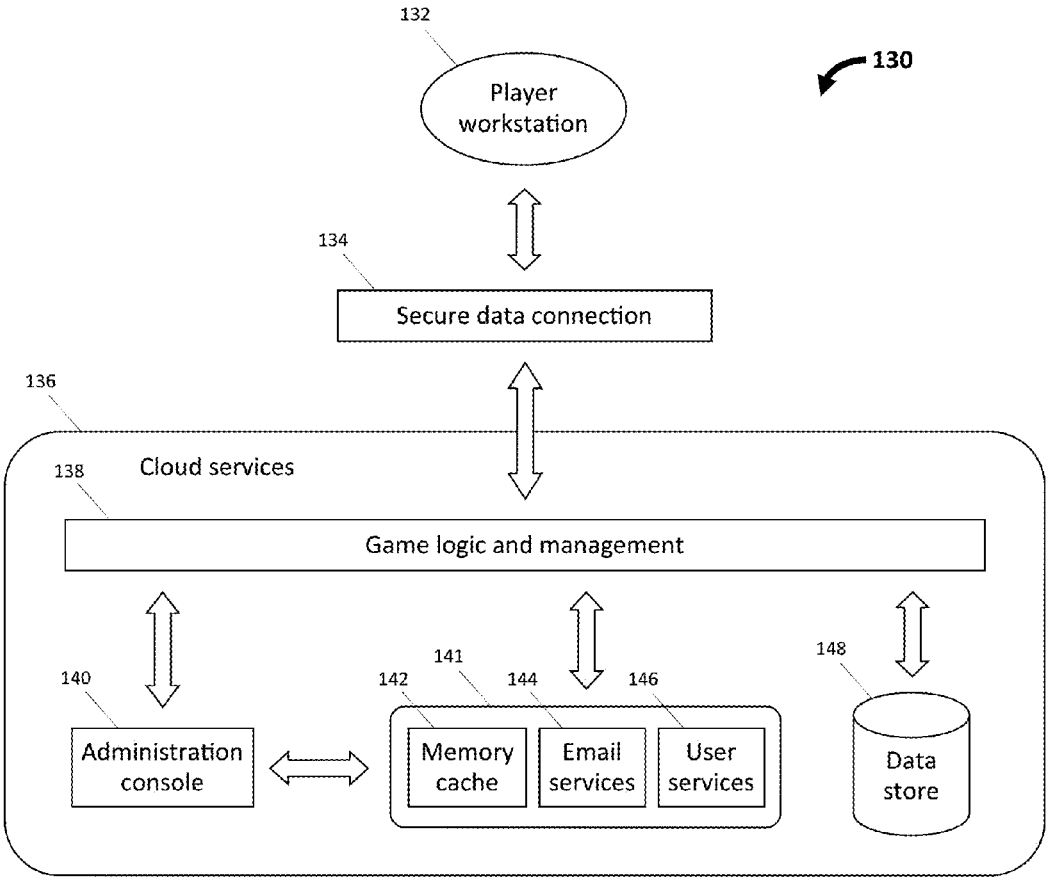
FIG. 8 is a block diagram of a software architecture and system for implementing a game on computers, in accordance with the embodiment of FIG. 7.
Figure 9:
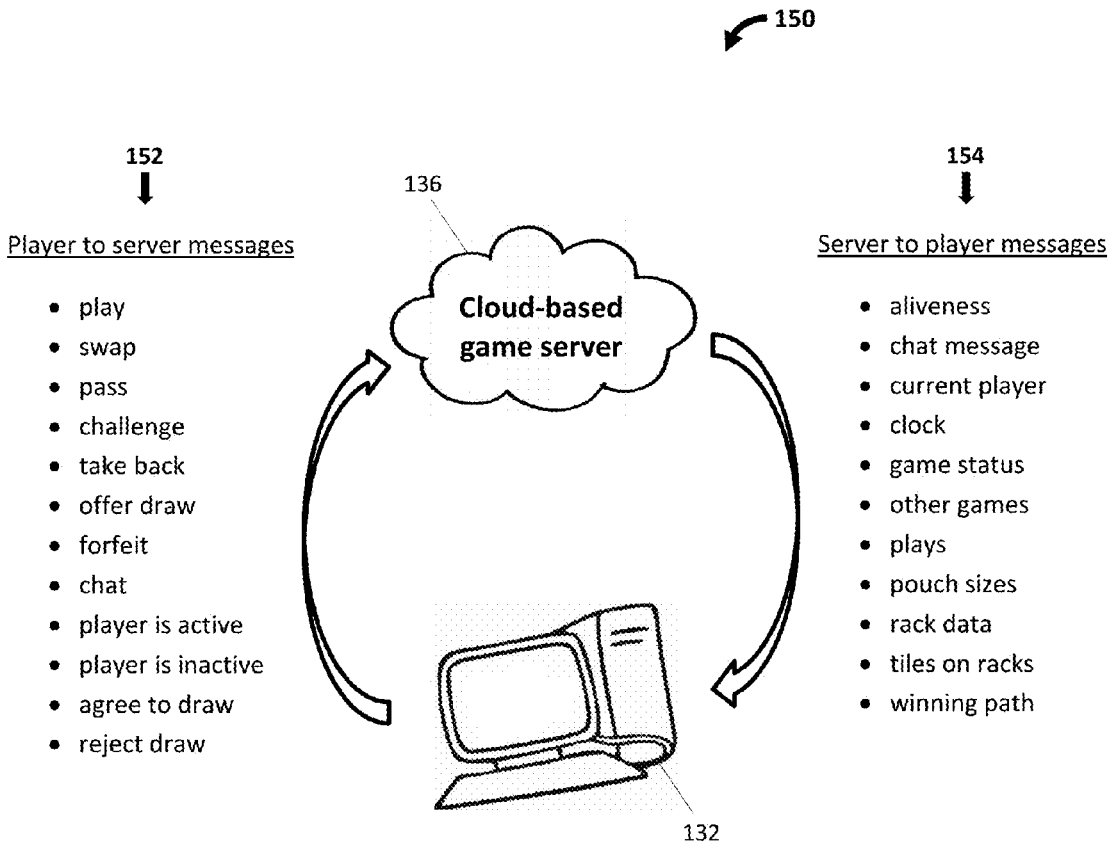
FIG. 9 is a schematic illustration showing communications between the game server and player workstation of FIG. 8.

FIGS. 7-9 provide an example of a computer-implemented system and method for playing a game according to methods described herein. FIGS. 8 and 9 are schematic representations of a game system 130, including a cloud-based game server 136 for controlling overall game functions and communications, and one or more player workstations 132 for interfacing with each player.

Turning now to FIG. 7, an sample screen shot from a user interface 80 (of player workstation 132 of FIG. 8) includes a board 10, black tiles 1, white tiles 1', and a virtual tile rack 26'. In this example, the rack 26', tiles 1' and orientation of board 10 are configured for display to the user playing the white tiles 1', e.g., with white end zones 16 oriented at the left and right of the board. Note that a player's end zones are preferably oriented to the left and right as they view the board 10, with the opponent's end zones at the top and bottom. Therefore, the player playing black tiles 1 would have a separate computer display and interface configured to display the rack having black tiles and with the board oriented with the black end zones 14 oriented towards the left and right of the board. Different screens or interface features may be used to choose player colors and/or to determine the order of play.

A user may manipulate game elements and features using a user input device, such as a computer mouse, keyboard, touchpad, or touch screen to interact with tiles, buttons and other interactive indicators or elements of interface 80 to play a game according to method 36 of FIG. 4. For example, during the white player's turn, the player may make a play 44, swap 45 or pass 46. To make a play, the user may use the input device to drag desired tiles 1' from rack area 26' into desired squares 12 of board 10 to spell a desired word. To swap tiles, the user may use the input device to tap, click, press or otherwise select (collectively referred to herein as "select") a Swap button 118. To pass, the user may click or otherwise select a pass button 106.

After a player plays tiles to the board, an opponent may challenge 49 as described above with respect to FIG. 4. In some embodiments, users may use a word checker 96 to determine the validity of a word, or the system may include instructions to determine the validity of a word automatically with or without a player challenge. Similarly, a play may be challenged with respect to the diagonal rule or other game rules as discussed above, e.g., by a player pressing a challenge button 112. In other embodiments, the game system may include instructions and logic to automatically determine whether the play is a legal play (e.g., step 50 of FIG. 4). In such embodiments, the need for the challenge step 49 may be eliminated.

Other user action features of interface may include buttons or selection options for Rotate 104, Surrender 108, Take Back 110, Shuffle 114 and Exit 120. For example, Rotate 104 may be used to rotate the view of board 10. Surrender 108 may be used by a player to forfeit a game or match, or to offer a tie game or match with the opponent may then accept or reject. Take Back 110 may be used, for example, to withdraw the player's last turn, which might be permissible in some embodiments if the opponent has not yet taken an action. Shuffle 114 may be used to rearrange randomly the tiles on a player's rack. Exit 120 may be used by a player to exit the current game and/or the game application. In some embodiments, one or more of the selectable buttons (e.g., buttons 104, 106, 108, 110 or 118) may change to provide different options depending upon the stage of the game. For example, once board 10 contains at least one tile, the Shuffle button 114 may change to "Recall" (e.g., for recalling all tiles to the rack 26') and the Swap button 118 may change to "Play".

Other aspects of interface 80 may include player panels 100, 102 and a communication panel 98. First player panel 100 may include one or more of an image 97 of the player (e.g., a photo, icon, symbol, or avatar); name 99; a current player turn indicator 84; and status information 86 such as the number of tiles on rack, number of tiles in the pouch (e.g., undrawn tiles), and/or the time remaining. Other relevant information may be incorporated or displayed as desired.

Communication panel 98 may be configured, for example, for chat communications between players. Other communication or information options may also be included in panel 98, such as, for example turn (or action) history, other active games and the frequencies of letters.

Other aspects of interface 80 may include a logo or other product or company identifier 82, user-created game title 88, a volume button 90, info button 92, and help button 94.

FIG. 8 provides a schematic diagram of an architecture of a game system 130 according to embodiments of the invention. The system includes one or more player workstations 132 in communication over a network with a collection of cloud services 136 (collectively and generically referred to herein as a server 136). While server 136 is preferably a cloud-based collection of services, in some embodiments one or more dedicated server systems may be used. Within the cloud are services specifically designed for game logic and management 138, where these include the game rules as well as general game management, such as the selection of opponents. Services are maintained by support personnel by means of an administration console 140. General services provided on the server 136 include short-term storage (the memory cache) 142, email functions 144 and services related to the management of players, for example user services 146. Long-term storage 148 keeps track of game and player data.

One or more player workstations 132, each including interface 80 as described above, preferably communicate over a network, e.g., via a secure data connection 134, with game server 136. Workstation 132 may be a desktop computer, laptop computer, tablet computer, handheld device, smart phone, set-top box or the like. Also, in some embodiments, the network is a wide area network (WAN), such as the Internet, while in other embodiments the network may be any other suitable network, such as a wired or wireless local area network or the like.

In some embodiments, a server memory 141 may include the memory cache 142, email services 144 and user services 146. In some embodiments, server memory 141 may also store game logic and management modules, as well as an operating system (or a set of instructions) that includes procedures for handling basic system services and for performing hardware dependent tasks.

FIG. 9 shows examples of messages or instructions 150 that may be communicated between the player's workstation 132 and the server 136 during the course of a game. For example, list 152 may include instructions or actions performed by the user via interface 80 as described above, e.g., for play, swap, pass challenge, etc. List 154 includes examples of messages that may be communicated from the server to a player, e.g., in response to requests or actions from the player.

Additional aspects or advantages of a computer-based implementation may include:

- A social game network may be used to find opponents for players anywhere in the world.
- The game server can keep track of game positions, so that players could take turns as their time schedules permit rather than playing at an agreed upon time.
- A game server may have programming instructions for simulating the play of a player, e.g., to allow a single player to play against a computer "opponent" of a desired skill or difficulty level. The server may also include instructions for providing help, instructions, and/or hints during the course of a game, even during a game between two humans if desired.
- Challenges may be handled with more flexibility. For example, the computer system may forbid without penalty any play that would violate the placement rules, and could do so without informing the opponent. If this method is used, the need for challenges is eliminated. Alternatively, the computer could permit plays that contain unacceptable words, and act as judge when plays are challenged. Such variations may be selectable by users as options before or during a game.
- A computer could easily keep a history of the players' actions and also manage various game functions such as the random allocation of tiles.

The reader will see that at least one embodiment provides a game which challenges the wordplay and strategic skill of its players. The game rules are clear enough to grasp quickly, yet mastery of the game requires serious study. Whether people play to practice word skills or to socialize or to compete, the game provides a satisfying experience.

While the above descriptions contain much specificity, they should not be construed as limitations on the scope but rather as exemplifications of preferred embodiments thereof. Other variations are possible. For example, the game colors need not be black and white but could instead be more pleasing colors as long as the distinction between the two is readily apparent. The size of the game board and the number of tiles could be increased or decreased to provide longer or shorter game times. The maximum number of tiles on a player's tile rack could be increased or decreased to promote longer or shorter word lengths. A game board in the form of a rectangle, cross or other shape could add additional interest. The end zones need not be stripes along the edges of the board but could be some other shape, or even squares on the board itself. The distribution of letters among the tiles could be changed if a better distribution is discovered. One or more wildcard tiles (indicated by a star or other symbol that exists in no alphabet) could be added to the tile set, and a person playing a wildcard tile would be required to state the associated letter when the tile is played. It might be allowable to take back a turn, or even a challenge, under some circumstances.

The game need not be limited to English. Apparatus for other languages (Arabic, Bulgarian, Catalan, Croatian, Czech, Danish, Dutch, Esperanto, Finnish, French, German, Greek, Hebrew, Hungarian, Icelandic, Irish, Italian, Latin, Latvian, Lithuanian, Malaysian, Norwegian, Polish, Portuguese, Romanian, Russian, Slovak, Slovenian, Spanish, Swedish, Turkish, Welsh) and for other alphabets (Arabic, Cyrillic, Greek, Hebrew, Armenian, Georgian) and alphabet variants can be constructed following the example of the English game. For an alphabet containing digraphs and/or trigraphs, the letter that appears on a tile might be composed of one, two or three characters associated with said alphabet.

The game can be adapted for tournament play by adding rules that specify time limits and other particulars that are not required for casual play. Such tournament rules are common to many board games and thus have not been included in either embodiment.

Team play is possible, where each player has their own private viewing area (rack) of tiles, while sharing a set of tiles, and players take turns in rotation. Team members cooperate to build a path of tiles in the team color.

The electronic display shown in FIG. 7 is only one possible rendering. For example, should the game be implemented for handheld devices, a simplified user interface may be employed.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

What is claimed is:

1. A method of playing a word game, comprising:

providing a board comprising a grid of a plurality of playing spaces and having at least two pairs of end zones disposed at opposing edges of the grid, each pair of the end zones assigned to a respective one of a plurality of players, the plurality of players including at least a first player and a second player, the first player having a first set of tiles and the second player having a second set of tiles distinguishable from the first set of tiles, a first plurality of the tiles of the first set and a second plurality of the tiles of the second set having a letter on a front surface, the end zones comprising a first pair of end zones disposed on opposing outer edges of the grid, and a second pair of end zones disposed adjacent to and between the first pair of end zones, and the first pair of end zones are marked with a first color corresponding to the first set of tiles and are assigned to the first player, and the second pair of end zones are marked with a second color corresponding to the second set of tiles and are assigned to the second player;

alternating turns in order by the plurality of players to be designated an active player, at least one turn for each player during the word game comprising:

placing one or more tiles of the respective set of tiles on the board with the front surface exposed, in one of a column and a row of unoccupied spaces on the board to form a word readable at least one of left-to-right and top-to-bottom as viewed from a position of the active player, each of the one or more tiles being placed diagonally to at least one previously played tile of the active player only if at least one tile of the active player is adjacent to both the one or more tiles being placed and the at least one previously played tile; and declaring a winner when one of the plurality of players forms a continuous path of adjacent tiles between the assigned pair of end zones.

2. The method of claim 1, wherein tiles may be placed by the active player adjacent to any previously played tiles of the active player only if acceptable words are formed in standard crossword fashion.

3. The method of claim 1, wherein a back surface of each tile in each set is indistinguishable from a back surface of other tiles in a same set.

4. The method of claim 1, further comprising:

assigning to the first player the first set of tiles;

assigning to the second player the second set of tiles; and designating to each of the players a respective predetermined number of tiles of a respective one of the first and the second sets of tiles to be drawn from the respective available tiles assigned to each of the players, the one or more tiles placed by the active player being selected from the respective predetermined number of tiles.

5. The method of claim 4, further comprising requiring the active player, after placing the one or more tiles of the respective set of tiles on the board, to replace the number of played tiles with a corresponding number of new tiles from the respective available tiles.

6. The method of claim 4, wherein in one of the alternating turns, the active player is permitted to position a single tile from a private tile viewing area of the active player to any unoccupied space within a shared playing area if the single tile is placed on the board with a back surface exposed, the single tile being placed diagonally to a second at least one previously played tile of the active player only if a third previously played tile of the active player is adjacent to both the single tile being placed and the second at least one previously played tile.

7. The method of claim 4, wherein in one of the alternating turns, the active player is permitted to at least one of:

exchange one or more tiles, chosen by the active player from a private tile viewing area of the active player, with an equal number of tiles selected randomly from the set of respective available tiles; and pass the turn to a next player without acting.

8. The method of claim 1, wherein:

a legality of a play in a turn may be challenged by any player who is not the active player;

if the play is determined to be legal, the player who is not the active player making the challenge misses a next turn; and if the play is determined to be illegal, the active player reverts the board to a state prior to the turn and play is passed to a next turn;

wherein the play is determined to be illegal at least when the word formed is not on a list of acceptable words.

9. The method of claim 1, further comprising declaring a draw if there is at least one of:

a predetermined number of sequential non-plays by the players, the non-plays being at least one of passes and swaps; and an agreement to the draw by the players.

10. The method of claim 1, wherein one or more tiles of each set of tiles includes a wildcard symbol, and wherein a letter represented by one of the one or more tiles having the wildcard symbol is announced by a player when the one of the one or more tiles is played.

11. The method of claim 1, wherein a maximum time limit is associated with each player, and wherein a particular player of the players loses if the maximum time limit associated with the particular player is exceeded.

12. The method of claim 1, wherein a player may take back a last turn of the player if no subsequent turn has yet been initiated.

13. The method of claim 1, wherein the board and the tiles are embodied by physical objects.

14. The method of claim 1, wherein the board and the tiles are embodied using at least one processor and at least one electronic display device.

* * * * *